United States Patent [19]

Livesey et al.

[11] 3,952,442

[45] Apr. 27, 1976

[54] LAUNCHER FOR A TOY VEHICLE, INCLUDING A SHIM FOR SUPPORTING THE VEHICLE REAR END

[75] Inventors: James Robert Livesey, Hawthorne; Felix Griauzde, Pleasonton, both of Calif.

[73] Assignee: Mattel, Inc., Hawthorne, Calif.

[22] Filed: Apr. 4, 1975

[21] Appl. No.: 565,186

[52] U.S. Cl. ..... 46/206; 124/10

[51] Int. Cl.[2] ..... A63H 17/26

[58] Field of Search ..... 46/1 K, 206, 202; 273/86 R, 129 D, 108, 119 R, DIG. 18; 124/10

[56] References Cited

UNITED STATES PATENTS

| | | | |
|---|---|---|---|
| 1,256,575 | 2/1918 | Koprinski | 124/10 X |
| 1,279,712 | 9/1918 | Knudsen | 124/10 X |
| 2,588,184 | 3/1952 | Walsh | 46/74 A |
| 2,816,536 | 12/1957 | Profitt | 124/10 X |
| 2,828,964 | 4/1958 | Horton | 273/129 D X |
| 3,018,584 | 1/1962 | Passariello | 124/10 X |
| 3,075,769 | 1/1963 | Cunningham | 124/10 X |
| 3,711,096 | 1/1973 | Cramp et al. | 124/10 X |

FOREIGN PATENTS OR APPLICATIONS

| | | | |
|---|---|---|---|
| 46,213 | 3/1966 | Germany | 273/86 R |
| A16,630 | 1913 | France | |

*Primary Examiner*—F. Barry Shay

*Attorney, Agent, or Firm*—Max. E. Shirk; Stephen L. King

[57] ABSTRACT

One end of an elongated launcher is placed on a rearwardly, downwardly sloping roof portion of a toy vehicle. The other end of the launcher is placed on the floor behind the vehicle so a child user may launch the vehicle by stepping on the launcher.

1 Claim, 6 Drawing Figures

10B
24B
26B
36
40
38
50
46
44
12
S 26B
40
42
38
24B
48
46
50
28B
44

LAUNCHER FOR A TOY VEHICLE, INCLUDING A SHIM FOR SUPPORTING THE VEHICLE REAR END

BACKGROUND OF THE INVENTION

The background of the invention will be set forth in two parts.

1. Field of the Invention

The present invention pertains generally to the field of propulsion mechanisms for toy vehicles and more particularly to a new and useful elongated launcher which may be placed on a rearwardly, downwardly sloping roof portion of a toy vehicle with the launcher extending behind the vehicle so that a child user may launch the vehicle by stepping on the launcher.

2. Description of the Prior Art

The prior art known to applicant is listed by way of illustration, but not of limitation, in separate communications to the United States Patent Office.

The present invention exemplifies improvements over this prior art.

SUMMARY OF THE INVENTION

It is a primary object of the present invention to provide a new and useful launcher for toy vehicles.

It is another object of the invention to provide a vehicle toy and launcher combination.

Yet another object of the present invention is to provide an elongated vehicle launcher having one end which may be placed on a rearwardly, downwardly sloping roof portion of a vehicle with the other end of the launcher being placed on the floor behind the vehicle so a child user may launch the vehicle by stepping on the launcher.

According to the present invention, a launcher is provided for a toy vehicle adapted to travel on a supporting surface. The vehicle includes a body portion sloping downwardly from a point intermediate the ends of the body to one end thereof.

The launcher comprises an elongated member having a first end positionable on the sloping body portion and another end positionable on the surface with the elongated member extending behind the vehicle a sufficient length to accommodate a child's foot, whereby a child user may step on the elongated member with a downward force having a resultant component moving the vehicle forwardly.

The elongated member is preferably a tough, flexible member and may be either straight throughout its length or may have the end which contacts the vehicle curved upwardly or downwardly.

Additionally, the end of the launcher which extends behind the vehicle may be swingably connected to the rear end of a base member having a guide provided at its front end for guiding the rear wheels of the vehicle as it leaves the launcher. Additionally, the base member may be provided with suitable stops engageable by the rear wheels of the vehicle when it is backed into position on the guide for controlling the position of the vehicle with respect to the working-end of the launcher.

Also, if desired, suitable shims may be provided on the base member beneath the rear end of the vehicle to control the amount the front end of the vehicle will be elevated when it is launched.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which like reference characters refer to like elements in the several views.

DESCRIPTION OF THE PREFERRED EMBODIMENTS

Figure 1:
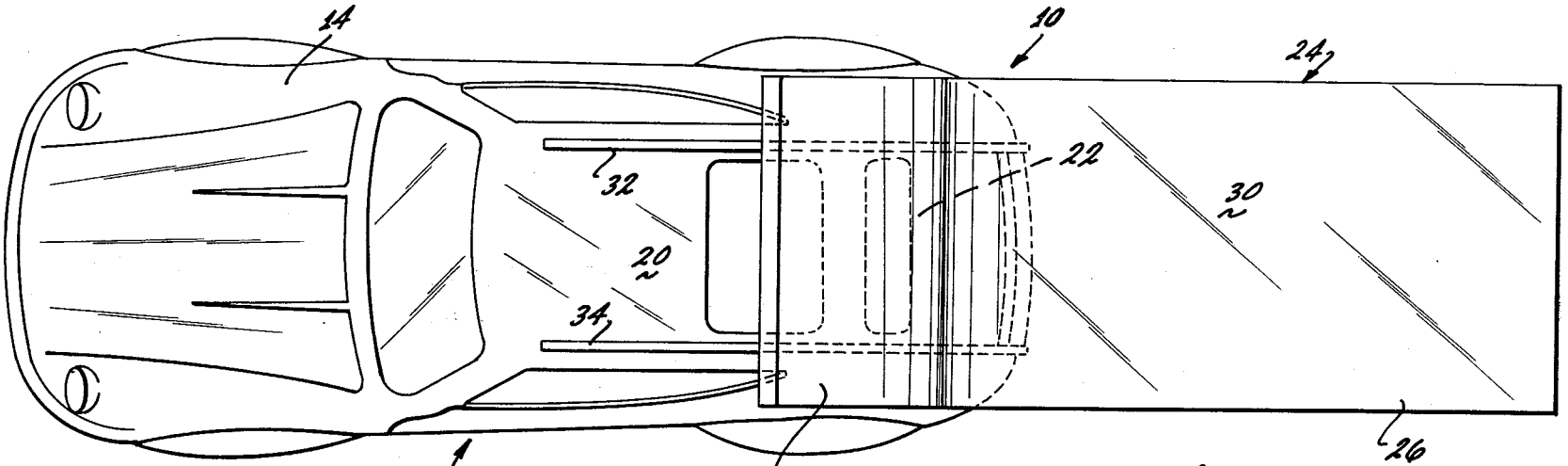
FIG. 1 is a plan view of a vehicle toy and launcher combination constituting a first embodiment of the present invention.
Figure 2:
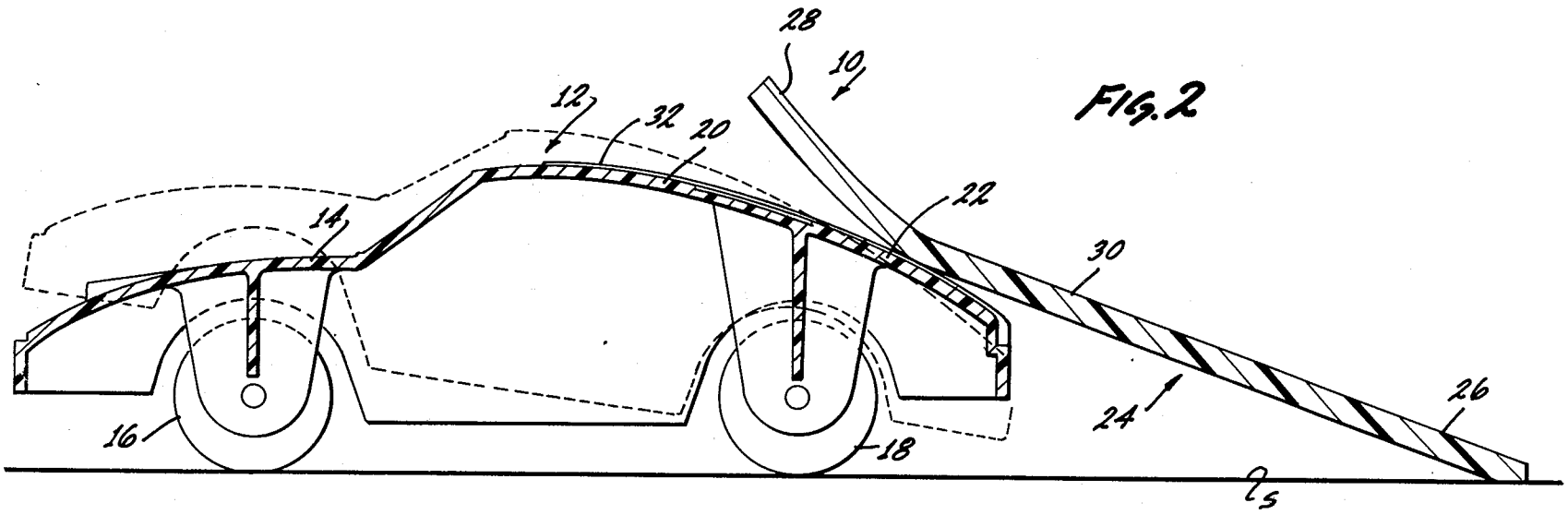
FIG. 2 is a longitudinal cross-sectional view of vehicle toy and launcher combination of FIG. 1.

Referring again to the drawings, and more particularly to FIGS. 1 and 2, a vehicle toy and launcher combination constituting a first embodiment of the present invention, generally designated 10, includes a vehicle toy 12 having a body 14, a pair of front wheels like the ones shown at 16 in FIG. 2, and a pair of rear wheels, like the ones shown at 18 in FIG. 2.

Vehicle body 14 includes a roof 20 having a rearwardly, downwardly sloping portion 22.

The vehicle-launcher combination 10 also includes a launcher 24 comprising an elongated member having a first end 26, adapted to be placed behind vehicle 12 on a surface S upon which vehicle 12 is adapted to travel. Launcher 24 includes an upwardly-curved end 28, adapted to be placed on the sloping portion 22 of body 14, and an intermediate portion 30.

Launcher 24 is preferably made from a flexible, tough material like polypropylene or high density polyethylene and may be about ¼ inch in thickness.

Vehicle 12 may also be made from a tough plastic material and roof 20 may be provided with a pair of ribs 32, 34 engageable by end 28 of launcher 24 to lessen the drag which would be imparted to launcher 24 if end 28 engaged roof 20 across its entire width.

It should be noted that intermediate portion 30 of launcher 24 extends a sufficient length behind vehicle 12 to accommodate a child's foot so that a child user may step on launcher 24 using his weight as a downward force having a resultant component moving vehicle 12 forwardly. This downward force causes vehicle 12 to rear upwardly to the position shown in broken lines in FIG. 2. This is sometimes referred to as a "wheelie position" and adds to the entertainment value of toy 10.

Figure 3:
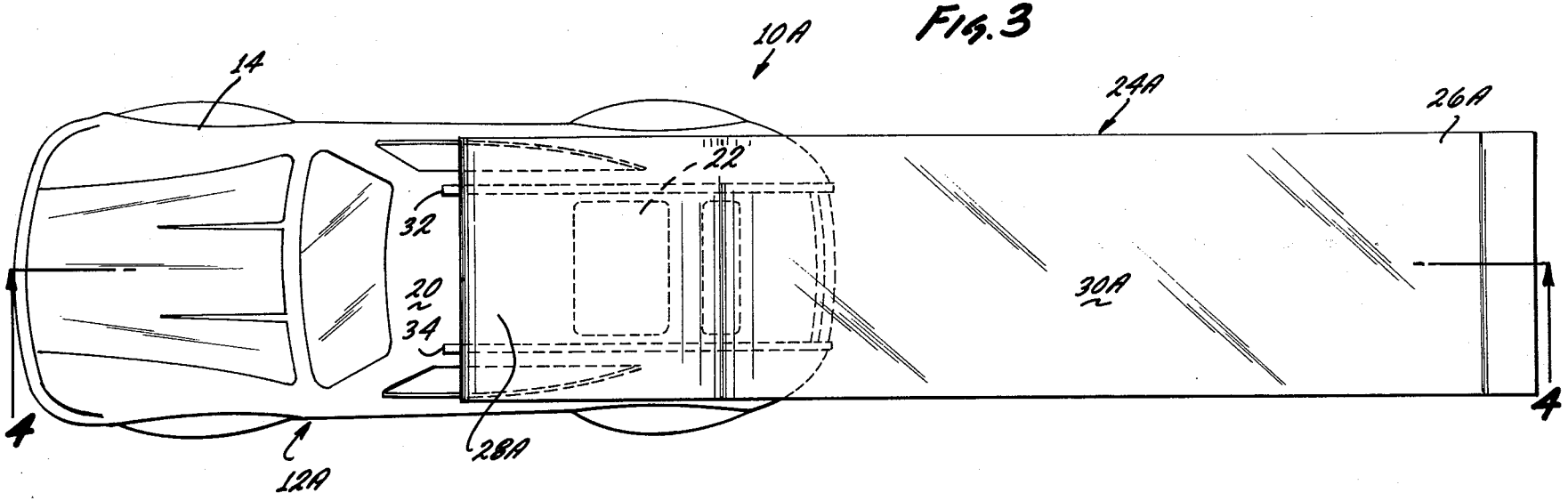
FIG. 3 is a plan view of a vehicle toy and launcher combination constituting a second embodiment of the present invention.
Figure 4:
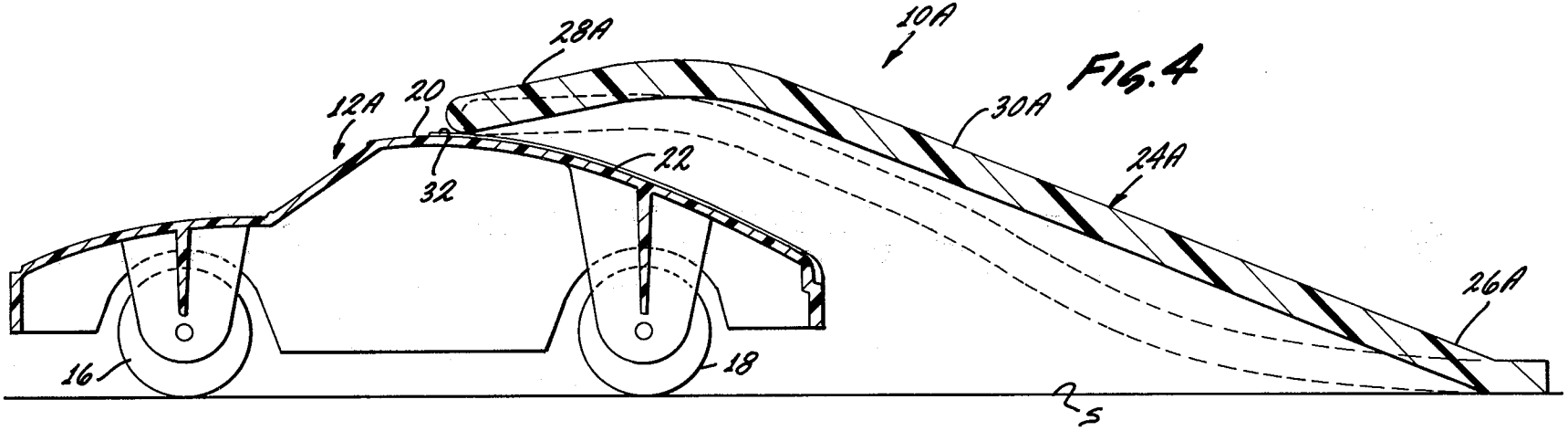
FIG. 4 is a cross-sectional view taken along line 4—4 of FIG. 3.

Referring now to FIGS. 3 and 4, a vehicle toy-launcher combination constituting a second embodiment of the present invention, generally designated 10A, includes the same vehicle 12 described in connection with the first embodiment. The toy 10A also includes a launcher 24A having an end 26A positionable upon surface S behind vehicle 12 and a downwardly-curved end 28A positionable upon ribs 32, 34 on sloping roof portion 22. Launcher 24A also includes an intermediate portion 30A extending behind vehicle 12 for a sufficient distance to accommodate a child's foot.

It should be noted that end 28A is shown for purposes of illustration, but not of limitation, as engaging roof 20 substantially forward of the point engaged by end 28 of launcher 24 so that end 28A of launcher 24A will engage roof 20 a substantially longer time when a child user steps on intermediate portion 30A moving it to the broken line position shown in FIG. 4. It will be apparent to those skilled in the art that a greater launching force will be obtained by placing the vehicle-engaging end of the launcher as far forward as possible on vehicle 12. It has also been found that a greater launching force can be obtained by employing a downwardly-curved launcher in place of the upwardly-curved launcher. Launcher 24A may be made from the same materials and be of the same thickness as the launcher 24.

Figure 5:
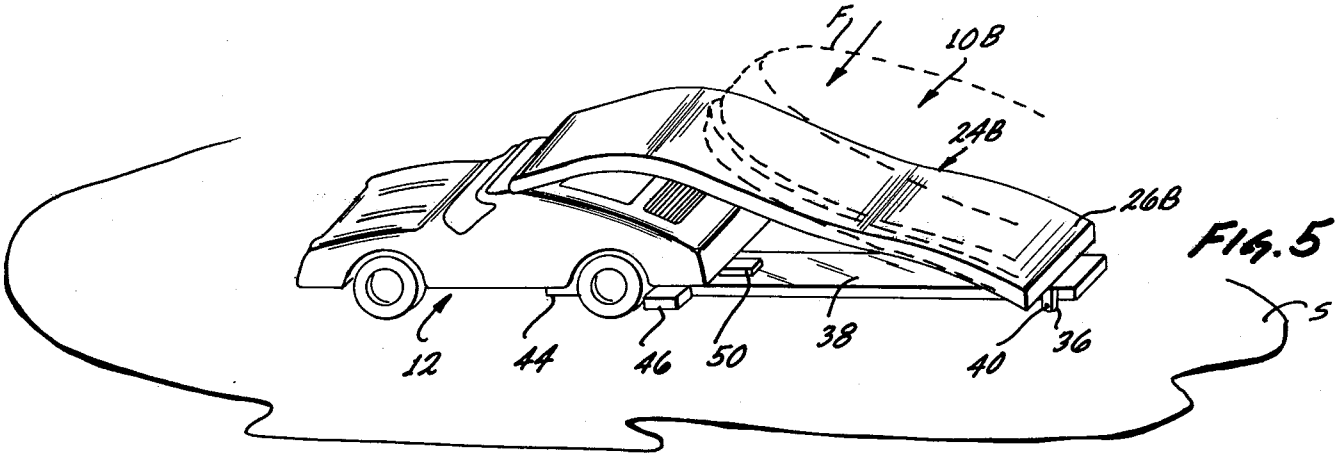
FIG. 5 is a perspective view of a vehicle toy and launcher combination constituting a third embodiment of the present invention.
Figure 6:
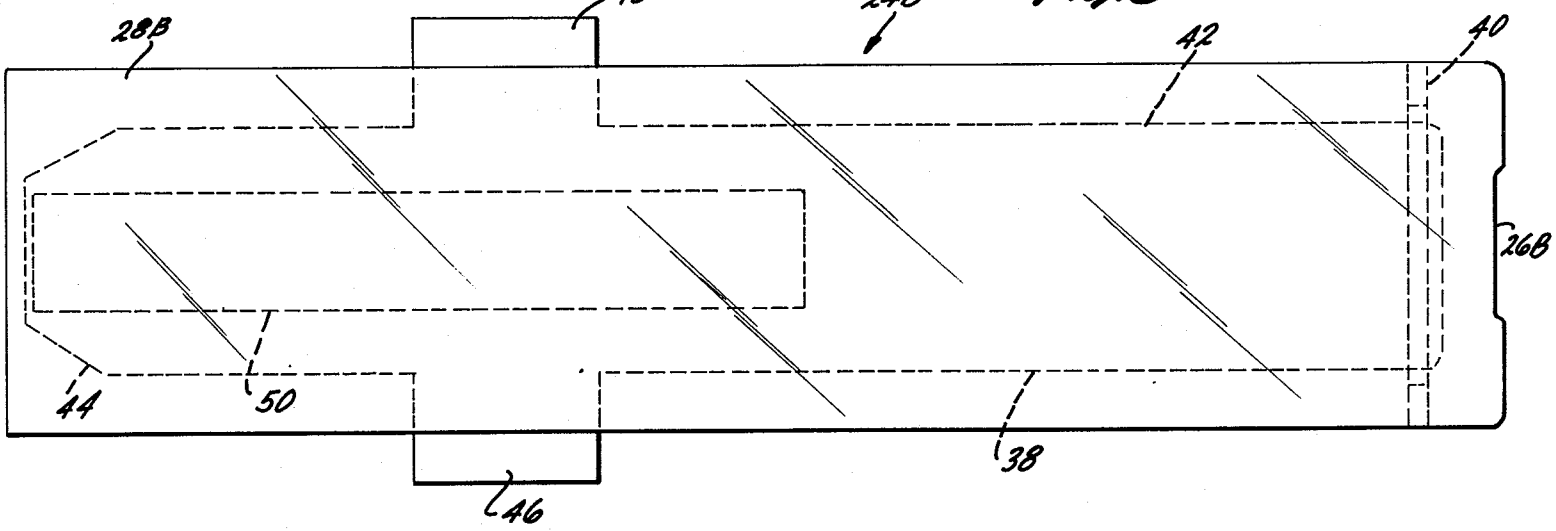
FIG. 6 is a plan view of the launcher shown in FIG. 5.

Referring now to FIGS. 5 and 6, a vehicle-launcher combination constituting a third embodiment of the present invention, generally designated 10B, includes the same vehicle 12 as that described in connection with the first two embodiments. Toy 10B also includes a launcher 24B which may be identical to the launcher 24A except that end 26B of launcher 24B carries a depending bracket 36 pivotally connected to a base plate 38 by a pin 40 passing through end 42 of base plate 38. Base plate 38 is adapted to lie upon surface S and includes an end 44 remote from the end 42. End 44 serves as a guide for the rear wheels of vehicle 12 so that vehicle 12 will leave launcher 24B on a straight path. Suitable locating stops 46, 48 may be provided on base member 38 near end 44 to serve as locators so that vehicle 12, when positioned in launcher 24B with its rear wheels straddling guide 44 and touching stops 46, 48, end 28B of launcher 24B will contact strips 32, 34 at the most forward portion of the rearwardly, downwardly-sloping portion of roof 20. This gives launcher 24B its most effective stroke when a child user places his foot F thereon.

The child user may control the amount the front end of vehicle 12 leaves the ground during launching by placing a suitable shim 50 on base member 38 beneath the rear end of vehicle 12.

In use, a child may place base member 38 on surface S, swing launcher 24B upwardly away from base 38 and position vehicle 12 on base 38 with wheels 18 straddling end 44 in contact with stops 46, 48. End 28B of launcher 24B may then be swung down into engagement with roof 20 of body 14 at the forwardmost point of the rearwardly-downwardly sloping portion. The child user may then place his foot F on launcher 24B using his entire weight to create a downward force having a resultant forward component which launches vehicle 12.

Static friction between end 28B of launcher 24B and vehicle 12 prevents car 12 from moving until substantial energy is stored in launcher 24B. It appears that this stored energy reacts faster than the child's foot producing a sort of snap propulsion of vehicle 12.

While the particular toy vehicle launchers herein shown and described in detail are fully capable of attaining the objects and providing the advantages hereinbefore stated, it is to be understood that they are merely illustrative of the presently preferred embodiments of the invention and that no limitations are intended to the details of construction or design herein shown other than as defined in the appended claims, which form a part of this disclosure.

Whenever the term "means" is employed in these claims, this term is to be interpreted as defining the corresponding structure illustrated and described in this specification or the equivalent of the same.

What is claimed is:

1. A launcher for launching a toy wheeled vehicle adapted to travel on a supporting surface, said vehicle having a body with a sloping roof portion and a bottom portion normally spaced from said surface, said launcher comprising:

a first elongated member having first and second ends;

means provided at said first end of said first elongated member for guiding said vehicle during launching;

means provided intermediate said first and second ends of said first elongated member for positioning said vehicle preparatory to launching;

a second elongated member having first and second ends;

means pivotally connecting said second end of said first elongated member to said first end of said second elongated member with said second elongated member overlying said first elongated member, said second end of said second elongated member imparting a forward thrust to said vehicle when it is in position on said vehicle guide means with said second end of said second elongated member contacting said sloping roof portion of said body and with a downward force being exerted on said second elongated member between the first and second ends thereof; and control means comprising a shim provided on said vehicle guide means beneath said vehicle bottom portion when said vehicle is in position on said guiding means for engagement by the rear end of said vehicle bottom portion to limit the amount the front end of said vehicle will become elevated while said second end of said second member is transmitting said downward force during launching of said vehicle.

* * * * *